United States Patent [19]

Longanbach

[11] 4,054,420

[45] Oct. 18, 1977

[54] PROCESS FOR THE DESULFURIZATION OF CARBONACEOUS FUELS WITH AQUEOUS CAUSTIC AND OXYGEN

[75] Inventor: James R. Longanbach, Claremont, Calif.

[73] Assignee: Occidental Petroleum Corporation, Los Angeles, Calif.

[21] Appl. No.: 460,155

[22] Filed: Apr. 11, 1974

[51] Int. Cl.[2] ..... C10L 9/10; C10B 57/00

[52] U.S. Cl. ..... 44/1 R; 201/17

[58] Field of Search ..... 201/17, 19; 44/1 R

[56] References Cited

U.S. PATENT DOCUMENTS

| | | | |
|---|---|---|---|
| 2,162,221 | 6/1939 | Kasehagen et al. | 44/1 R |
| 3,009,781 | 11/1961 | Johnson et al. | 201/17 |
| 3,214,346 | 10/1965 | Mason et al. | 201/17 X |
| 3,393,978 | 7/1968 | Murphy et al. | 201/17 X |
| 3,707,462 | 12/1972 | Moss | 201/17 X |
| 3,824,084 | 7/1974 | Dillon et al. | 44/1 R |

*Primary Examiner*—Carl F. Dees

*Attorney, Agent, or Firm*—Forrest E. Logan

[57] ABSTRACT

This invention covers a process for reducing the sulfur content of carbonaceous fuels by treatment at elevated temperatures in a system comprised of aqueous caustic and oxygen.

17 Claims, No Drawings

PROCESS FOR THE DESULFURIZATION OF CARBONACEOUS FUELS WITH AQUEOUS CAUSTIC AND OXYGEN

BACKGROUND OF THE INVENTION

Carbonaceous fuels, such as coal and coal char, generally contain sulfur and produce sulfur dioxide upon combustion, an objectionable air pollutant. The presence of sulfur in carbonaceous fuels is further objectionable because of governmental air purity standards which restrict the use of fuels to those containing relatively low concentrations of sulfur. The need for relatively sulfur-free carbonaceous fuels is therefore very important, especially in view of dwindling supplies of oil and natural gas and abundant supplies of coal and other carbonaceous materials which may be utilized as a fuel.

Carbonaceous fuels may be desulfurized by treatment with hot, molten caustic materials such as sodium hydroxide, potassium hydroxide, and the like. Aqueous solutions of caustic materials may also be employed to desulfurize carbonaceous fuels but the degree of desulfurization is not nearly as great as when a hot melt of the caustic materials is employed.

SUMMARY OF THE INVENTION

It has been discovered that greatly improved results in desulfurizing carbonaceous fuels are achieved with an aqueous caustic solution is an oxygen containing gas is introduced into the solution.

EMBODIMENT OF THE INVENTION

A carbonaceous fuel, such as coal or coal char, is admixed with an aqueous solution of caustic. The carbonaceous fuel is preferably prepared in small particles prior to admixing with the aqueous caustic solution to expose a substantial amount of the fuel's surface to the solution. The materials used to form the caustic bath are preferably sodium hydroxide, potassium hydroxide, but any other caustic substance, such as for example, calcium oxide or sodium carbonate, or any combination thereof, should work as well.

The aqueous caustic solution may comprise about 1 to about 70% by weight of caustic material. In the preferred embodiment, the aqueous caustic solution comprises a range of about 10 to about 50% by weight of caustic, and preferably is 25% by weight of caustic.

The ratio of caustic to carbonaceous fuels should be maintained at a level which will effect maximum desulfurization. This ratio is at least ten parts of caustic to about one part of sulfur in the carbonaceous fuel, and preferably is at least 20 parts of caustic per one part of sulfur. This ratio may be increased but it will not result in any appreciable increase in desulfurization relative to the increased ratio of caustic to fuel.

When the carbonaceous fuel is introduced into the aqueous caustic solution, it may be admixed therein by means of a motor-driven stirrer or other equivalent means which will provide a thorough mixing of the fuel with the aqueous caustic solution for intimate contact therebetween. Oxygen containing gas is introduced into the aqueous caustic system by suitable means and in an amount to provide at least 2 grams of oxygen for every 1% by weight of sulfur present in the initial fuel. This aqueous-caustic-oxygen system is maintained at a temperature of about 200° to about 1600° F. for a period of time of about 1 to about 300 minutes to effect desulfurization. The fuel is thereafter washed with water to remove the caustic materials and the water soluble sulfate salts formed as a result of the aforesaid treatment.

It is not fully understood why the presence of oxygen should improve the desulfurizing effect of the aqueous solution or what chemical reactions are occurring during said desulfurization. It has been observed, however, that virtually all of the sulfur that is removed from the fuel by the instant invention is in the form of alkali sulfates and thus the invention also provides a means for the manufacture of such sulfates.

EXAMPLE I 50 grams of −50 mesh coal characterized as run-of-the-mine (ROM), Hamilton high volatile bituminous coal (HVCB), was admixed with 100 grams of sodium hydroxide, 100 grams of potassium hydroxide and 200 milliliters of water in a Hasteloy C autoclave liner until the caustic was dissolved in the water. The liner was sealed in an autoclave, heated to 660° F., and vented to a pressure of 800 psig. Oxygen gas, under a pressure of 800 psig, was introduced into the mixture at a flow rate of 400 milliliters per minute. The temperature of the system and oxygen pressure and flow rate were maintained as aforesaid for a period of 10 minutes. Thereafter, the autoclave was sealed and allowed to cool overnight. The following morning the autoclave and liner were opened. The coal was separated from the aqueous caustic solution, washed in water to remove the caustic, filtered and dried. The dry weight recovery was 48.85% of the original weight of the coal. The recovered coal was analyzed and the sulfur content was found to be 4.01% of the original content of the sulfur. An analysis of the coal before and after treatment in the liner is set forth below in Table 1.

Table 1

| | Before | | After | |
|---|---|---|---|---|
| | Percent | Percent Dry Basis* | Percent | Percent Dry Basis |
| Water | 7.16 | 0 | 1.14 | 0 |
| Ash | 8.30 | 8.94 | 5.32 | 5.38 |
| Carbon | 67.50 | 72.70 | 81.85 | 82.79 |
| Hydrogen | 5.35 | 4.90 | 5.17 | 5.10 |
| Nitrogen | 1.58 | 1.70 | 1.70 | 1.72 |
| Sulfur | 2.63 | 2.83 | 0.23 | 0.23 |
| Oxygen | | 8.93 | | 4.78 |
| Total Weight | 50 grams | 46.42 grams | 22.94 grams | 22.68 grams |

*The water content was excluded from the total analysis which was recalculated.

EXAMPLE II

Example I was rerun using the same materials, procedures and operating conditions except that the mixture of coal and aqueous caustic-oxygen system was heated to 660° F. and maintained at that temperature for 30 minutes. When the autoclave and liner were opened the following morning it was observed that there was no aqueous solution remaining in the liner. The dry weight recovery was 52% of the original weight of the coal. The recovered coal was analyzed and the sulfur content was found to be 0.3% of the original content of the sulfur. An analysis of the coal before and after treatment in the liner is set forth below in Table 2.

Table 2.

| | Starting Coal | | Desulfurized Coal | |
|---|---|---|---|---|
| Moisture | 5.42% | Dry | .55% | Dry |
| Ash | 18.52 | 19.58% | 19.34 | 19.45% |
| C | 57.94 | 61.26 | 69.90 | 70.29 |

Table 2.-continued

| | Starting Coal | | Desulfurized Coal | |
|---|---|---|---|---|
| H | 4.40 | 4.02 | 3.84 | 3.80 |
| N | 1.13 | 1.19 | 1.12 | 1.13 |
| S | 4.12 | 4.36 | .03 | .03 |
| O | | 9.59 | | 5.30 |
| Weight | 50g | 47.29g | 24.81g | 24.67g |

The reduction in weight of the original 50-gram specimen in Examples I and II is believed to be due to the loss of sulfur as sulfates and the partial gasification of the coal.

It is to be understood that, while the operating conditions of time, pressure, temperature, flow rate, and ratio of materials set forth herein appear to be practical ranges for use in the instant invention, each one of these operating conditions is subject to a wide degree of variability depending upon the remaining operating conditions, and it is to be understood that this invention is intended to cover all changes and modifications in such operating conditions and materials which fall within the spirit and scope of the invention.

What I claim as my invention is:

1. In a process for reducing the sulfur content of carbonaceous fuels, the step comprising treating said carbonaceous fuels at elevated temperatures in a system comprised of aqueous caustic and oxygen.

2. In a process as set forth in claim 1, wherein said system comprises at least 10 parts of caustic to about 1 part of the sulfur in the carbonaceous fuel to be treated, and an initial amount of water of at least about 100 parts to about 100 parts of caustic.

3. In a process as set forth in claim 1, wherein said system is maintained at a temperature of from about 200° to about 1600° F., said oxygen is introduced into said system in an amount to provide at least about 2 grams of oxygen for every 1% by weight of sulfur present in the initial fuel.

4. In a process as set forth in claim 1, wherein said system is maintained at a temperature of about 200° to about 1600° F., and comprises at least about 20 parts of caustic to about 1 part of sulfur in the carbonaceous fuel, to about 100 parts of water, and wherein said oxygen is introduced into said system in an amount to provide at least about 2 grams of oxygen for every 1% by weight of sulfur present in said fuel.

5. In a process as set forth in claim 4, wherein said treated fuel is washed with water to remove the caustic and sulfur compounds formed as a result of said aqueous caustic-oxygen treatment.

6. In a process as set forth in claim 5, wherein said sulfur compounds are recovered from said wash water.

7. A process for reducing the sulfur content of carbonaceous fuel comprising the following steps:

a. introducing carbonaceous fuel containing sulfur into an aqueous solution of caustic;

b. heating said aqueous solution of caustic containing said carbonaceous fuel;

c. introducing oxygen into said aqueous solution of caustic, maintained at an elevated temperature, thereby reducing the sulfur content of said carbonaceous fuel; and d. removing said carbonaceous fuel from said aqueous solution of caustic after treament with said oxygen in said aqueous solution of caustic.

8. A process for reducing the sulfur content of carbonaceous fuel as recited in claim 7 wherein said aqueous solution is heated to a temperature of about 200° to about 1600° F, and is maintained at said temperature during said oxygen treatment.

9. A process for reducing the sulfur content of carbonaceous fuel as recited in claim 7 wherein said caustic comprises an alkali metal or an alkaline earth metal compound of a hydroxide, an oxide, a carbonate, or mixtures thereof.

10. A process for reducing the sulfur content of carbonaceous fuel as recited in claim 7 wherein the amount of said oxygen introduced into said aqueous solution of caustic is at least about 2 grams of oxygen for every 1 percent by weight of sulfur initially present in said particulate carbonaceous fuel.

11. A process for reducing the sulfur content of carbonaceous fuel as recited in claim 7 wherein said caustic comprises sodium hydroxide, potassium hydroxide, or mixtures thereof.

12. A process for reducing the sulfur content of carbonaceous fuel as recited in claim 7 wherein said oxygen is contained in an oxygen containing gas.

13. A process for reducing the sulfur content of carbonaceous fuel comprising the following steps:

a. introducing particulate carbonaceous fuel containing sulfur into an aqueous solution of caustic, said caustic comprising an alkali metal or an alkaline earth metal compound of a hydroxide, an oxide, a carbonate, or mixtures thereof;

b. heating said aqueous solution of caustic containing said particulate carbonaceous fuel to a temperature of about 200° to about 1600° F;

c. introducing into said solution which is maintained at a temperature of about 200° to about 1600° F, at least about 2 grams of oxygen for every one percent by weight of sulfur initially present in said particulate carbonaceous fuel for a period of time of about 1 minute to about 300 minutes, thereby reducing the sulfur content of said particulate carbonaceous fuel; and d. removing said particulate carbonaceous fuel from said aqueous solution of caustic after said treatment with said oxygen in said aqueous solution of caustic.

14. A process for reducing the sulfur content of carbonaceous fuel as recited in claim 13 wherein said particulate carbonaceous fuel is coal.

15. A process for reducing the sulfur content of carbonaceous fuel as recited in claim 13 wherein said particulate carbonaceous fuel is coal char.

16. A process for reducing the sulfur content of carbonaceous fuel as recited in claim 13 wherein said caustic comprises sodium hydroxide, potassium hydroxide, or mixtures thereof.

17. A process for reducing the sulfur content of carbonaceous fuel as recited in claim 13 wherein said oxygen is contained in an oxygen containing gas.

* * * * *